US008979053B2

(12) United States Patent
Deal et al.

(10) Patent No.: US 8,979,053 B2
(45) Date of Patent: Mar. 17, 2015

(54) LADDER STANDOFF SUPPORT FOR A ROOF

(71) Applicant: Foster, Deal & Sons Inc., Speedway, IN (US)

(72) Inventors: Thomas A. Deal, Indianapolis, IN (US); Robin L. Foster, Gosport, IN (US)

(73) Assignee: Foster, Deal & Sons Inc., Speedway, IN (US)

( * ) Notice: Subject to any disclaimer, the term of this patent is extended or adjusted under 35 U.S.C. 154(b) by 126 days.

(21) Appl. No.: 13/869,463

(22) Filed: Apr. 24, 2013

(65) Prior Publication Data

US 2013/0284870 A1 Oct. 31, 2013

Related U.S. Application Data

(60) Provisional application No. 61/638,153, filed on Apr. 25, 2012.

(51) Int. Cl.

| | |
|---|---|
| ***A47G 29/02*** | (2006.01) |
| ***E04G 3/20*** | (2006.01) |
| ***E06B 7/28*** | (2006.01) |
| ***E06C 7/48*** | (2006.01) |
| ***E06C 7/50*** | (2006.01) |

(52) U.S. Cl.
CPC .... *E06C 7/48* (2013.01); *E06C 7/50* (2013.01)
USPC ..... 248/237; 182/116; 182/200; 182/214

(58) Field of Classification Search
CPC ..... E06C 7/48; E06C 7/50
USPC ..... 248/237; 182/107, 116, 200, 214, 216
See application file for complete search history.

(56) References Cited

U.S. PATENT DOCUMENTS

| | | | | |
|---|---|---|---|---|
| 2,329,415 | A * | 9/1943 | Osborne | 248/237 |
| 2,541,343 | A * | 2/1951 | Dakin | 248/238 |
| 2,881,028 | A * | 4/1959 | Baird | 182/116 |
| 3,459,277 | A * | 8/1969 | Frederick | 182/214 |
| 4,306,635 | A * | 12/1981 | Mitchell | 188/72.4 |
| 4,331,217 | A * | 5/1982 | Stecklow | 182/214 |
| 4,941,547 | A * | 7/1990 | Livick | 182/107 |
| 5,165,501 | A * | 11/1992 | Donahey | 182/214 |
| 5,503,358 | A * | 4/1996 | Lapp | 248/235 |
| 6,152,261 | A * | 11/2000 | Hoey | 182/107 |
| 7,377,360 | B1 * | 5/2008 | Misiak et al. | 182/107 |
| 8,196,705 | B2 * | 6/2012 | Jejina | 182/150 |

OTHER PUBLICATIONS http://www.google.com/products/catalog?q=ladder+jack&rls=com.microsoft:en-us&oe=UT - WernerAC10-14-02 14" Aluminum Ladder Jacks - Werner Co. Corporate Headquarters, 93 Werner Road, Greenville, PA 16125.

* cited by examiner

*Primary Examiner* — Amy Sterling
(74) *Attorney, Agent, or Firm* — Woodard, Emhardt, Moriarty, McNett & Henry LLP

(57) ABSTRACT

A standoff support for spacing a ladder and ladder jack from a roof. Two pairs of rods are pivotably mounted to a horizontally extending member mounted atop a ladder jack secured to a ladder. The rods are extended outwardly from the mounting member to stabilize and limit movement of the ladder jack and ladder relative to the roof.

5 Claims, 6 Drawing Sheets

LADDER STANDOFF SUPPORT FOR A ROOF

BACKGROUND OF THE INVENTION

1. Field of the Invention

The present invention relates generally to the field of supports used to hold a ladder in stable relationship to a slanted or unslanted roof.

2. Description of the Prior Art

Ladder jacks, one example of which is shown in FIGS. 1 and 2, are devices that are used to mount to a ladder for supporting a scaffold or other platform atop the ladder jack. Ladder jacks are commercially available. For example, ladder jacks are available from Werner Co. Corporate Headquarters, 93 Werner Road, Greenville, Pa. 16125.

A typical ladder jack 30 (FIGS. 1 and 2) includes a horizontally extending member 31 pivotally and slideably mounted to the top end of angular member 32. Member 31 is also pivotally mounted to a downwardly extending member 33 having a bottom end pivotally mounted to the bottom of angular member 32. A pair of downwardly opening C-shaped walls 34 and 35 attached to member 33 are slipped over the horizontally extending rungs of a conventional extension ladder 40. A scaffold or platform 41 rests atop and is supported by member 31.

Typically, two ladder jacks are positioned one at each end of scaffold 41 to support the opposite ends thereof and thus, a pair of extension ladders are used with each ladder receiving a ladder jack. FIG. 1 shows one such ladder jack mounted to a ladder and supporting one end of the scaffold. FIG. 2 shows the same ladder jack only with the scaffold removed to illustrate features present atop horizontal member 31. A right angle bracket 43 has its horizontal flange fixedly attached to the distal end 49 of horizontal member 31 and also has a vertically extending portion 44 that extends upwardly from member 31. Member 31 includes a horizontally extending slot 45 with a conventional fastener 47 extending through the slot. A downwardly opening C-shaped clamp 48 is mounted to member 31 by fastener 47 and provides a stop surface for any movement of the scaffold toward the distal end 49 of member 31. A second downwardly opening C-shaped clamp 50 is mounted to the proximal end 51 of member 31 by means of a conventional fastening device that extends through member 31. The mutually facing surfaces of clamps 50 and 48 provide limits for horizontal movement of the platform positioned between clamps 50 and 48. Alternatively, clamps 48 and 50 may be slipped over the edges of scaffold 41 to limit movement of the scaffold. The top end of upright member 33 is pivotally mounted to member 31 with the bottom end of member 33 pivotally mounted to the bottom end of angular member 32.

Slot 53 (FIG. 1) extends along the length of vertical wall portion 54 of member 31 with the top end of angle member 32 having a fastening device 55 that extends through slot 53 allowing the top end 36 of member 32 to be adjusted along the length of the horizontal member 31 thereby adjusting positioning of member 33 enabling walls 34 and 35 to be slipped over the ladder rungs while maintaining the horizontal position of member 31 and the scaffold placed there atop. The fastening device 55 is then tightened to maintain the positions of angle member 32, upright member 33 and horizontal member 31.

DESCRIPTION OF THE PREFERRED EMBODIMENT

Figure 1:
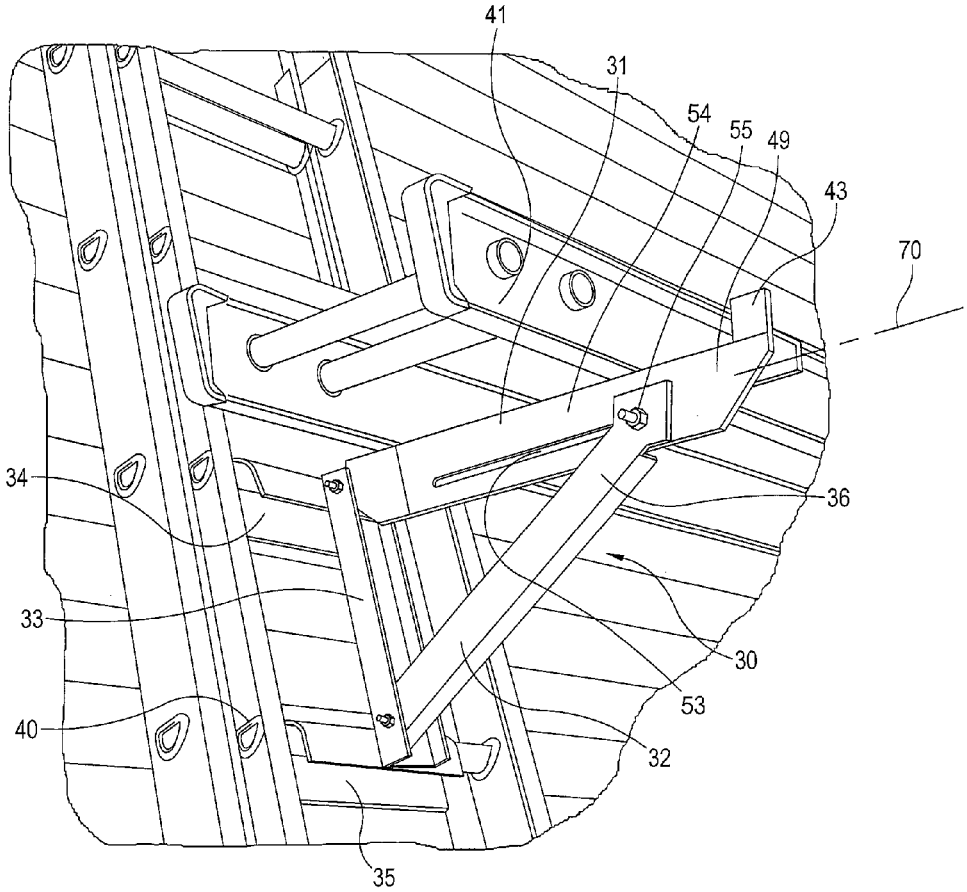
Fig. 1 (PRIOR ART)
FIG. 1 is a fragmentary perspective view of a prior art ladder jack mounted to an extension ladder and supporting a scaffold.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

When utilizing an extension ladder to provide access for a worker to the top portion of a building and even the roof itself, the ladder may be rested against the building. Pressure from the ladder as the worker stands on the ladder may result in damage to the building including gutters and shingles. I have therefore combined a standoff device with the previously described ladder jack. In most cases the roof will slant thereby decreasing the stability of the ladder as it rests against the building.

Figure 3:
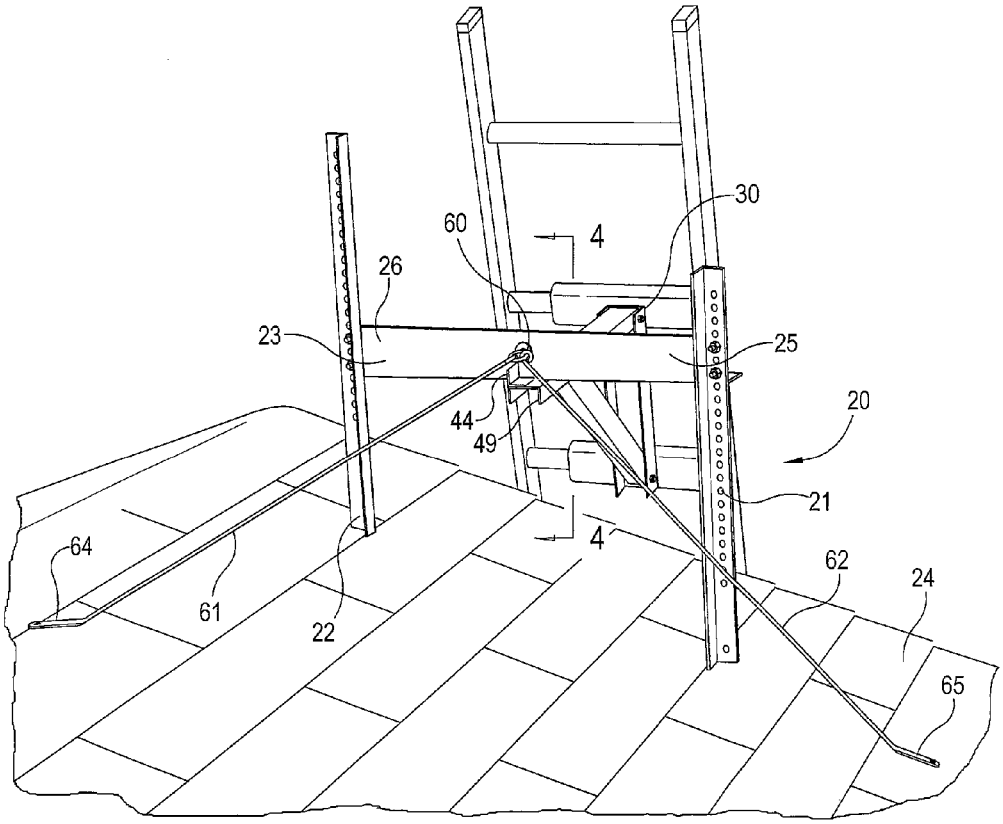
FIG. 3 is a perspective view of an alternate embodiment of a standoff support positioned atop a roof and attached to the ladder jack of FIG. 2.

Referring to FIG. 3, an alternate embodiment of the standoff device 20 includes a pair of upright right angle posts 21 and 22 connected together by horizontally extending member 23. The opposite ends of member 23 are secured to posts 21 and 22 by conventional bolt/nut combinations. Each post 21 and 22 includes a series of holes extending there through along the length of each post enabling member 23 to be connected to the post at various locations along the length of the posts.

Roof 24 has a downward slant as viewed from the left to the right in FIG. 3. End 25 of member 23 is mounted toward the top end of post 21 while end 26 of member 23 is mounted toward the bottom end of post 22 to position member 23 horizontally thereby maintaining member 23 in a horizontal position.

Figure 4:
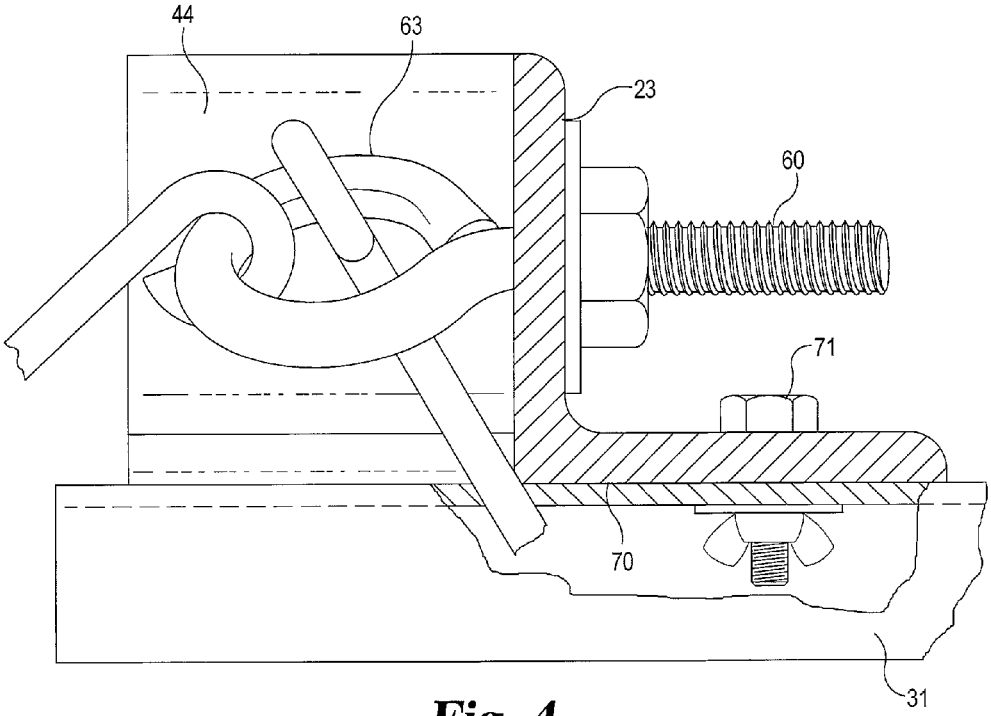
FIG. 4 is an enlarged fragmentary cross-sectional view of eye bolt 60 taken along line 4-4 of FIG. 3.

An eye bolt 60 is fixedly attached to the center of member 23. Stabilizing rods 61 and 62 (FIG. 3) have top ends pivotally connected to the ring shaped outer end 63 (FIG. 4) of eye bolt 60. The bottom ends 64 and 65 respectively of stabilizing rods 61 and 62 are bent at an angle with respect to the main body of each rod so the top end of each rod may be moved and pivoted in the ring shaped end 63 to allow ends 64 and 65 to seat in a parallel relationship to the roof. The rods extend outwardly of posts 21 and 22. That is, the distance between post 21 and 22 is less than the distance between outer ends 64 and 65. Rods 61 and 62 can be positioned at various angles thereby increasing the stability of standoff 20.

Figure 2:
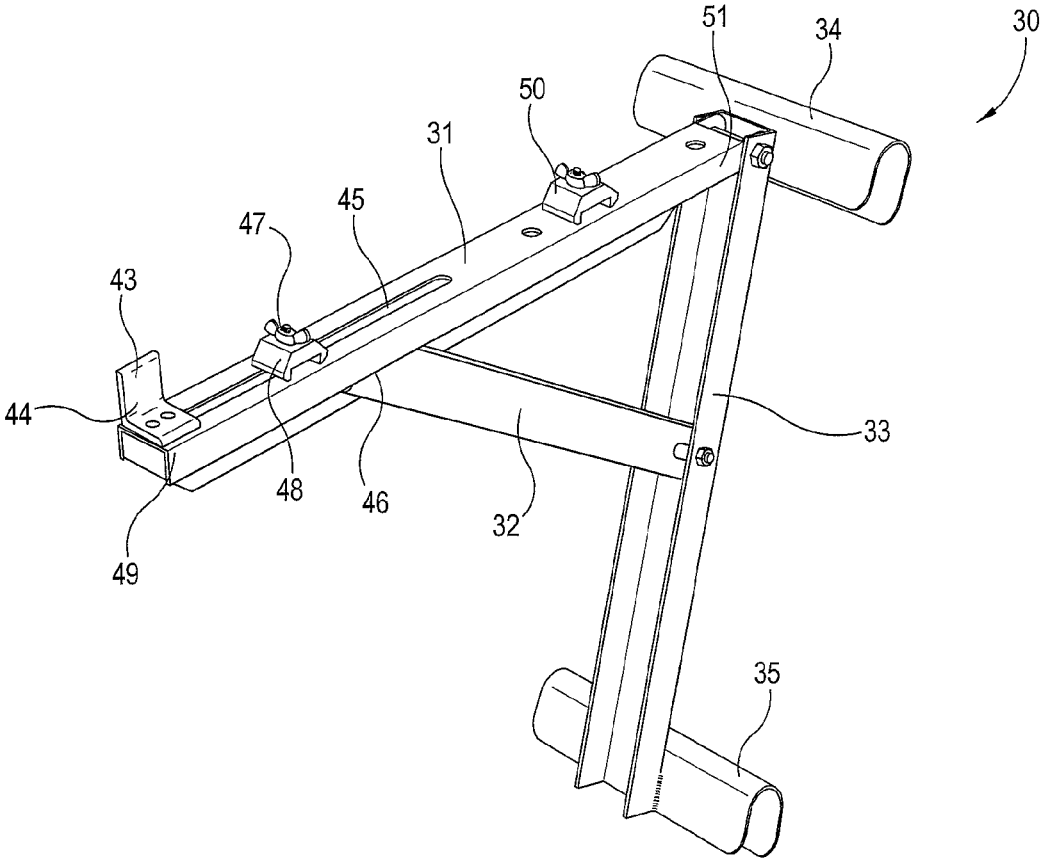
Fig. 2 (PRIOR ART)
FIG. 2 is a perspective view of the prior art ladder jack shown in FIG. 1 only with the scaffold and ladder removed.

The distal end 49 of member 31 is connected to the horizontal wall of the L-shaped member 23. A conventional bolt/nut combination 71 connects member 23 of support 20 to the horizontal member 31 of the ladder jack. The shank of the bolt extends through slot 45 while wall 44 (FIG. 2) is positioned outward of member 23.

In order to utilize our new standoff, posts 21 and 22 are adjusted with respect to member 23 taking into account the slanted roof with the bottom end of each post resting atop the roof while member 23 is horizontal. Supporting rods 61 and 62 are then adjusted to contact the roof outwardly of posts 21 and 22. Further, the rods may be extended away from member 23 thereby further increasing the stability of the support. The ladder jack prior to positioning rods 61 and 62 has been assembled with respect to member 23 with fastener 71 being in a loosened state to allow fastener 71 to be adjusted along the length of slot 45 taking into account the positioning of the ladder having its rungs mounted to the downwardly opening C-shaped walls 34 and 35. Once the ladder extends upwardly at an appropriate angle to allow the worker to climb the ladder, fastener 71 is tightened enabling the worker to climb the ladder in a stable condition. Rods 61 and 62 support the standoff on one side of the standoff whereas ladder 40 being attached to the opposite end of the ladder jack supports the opposite side of the support. Further, supporting rods 61 and 62 increase the stability of the combination. Rods 61 and 62 as well as ladder 40, all being attached to the ladder jack, provide stability along the lengthwise extending axis 70 (FIG. 1) of member 31. Likewise, supporting rods 61 and 62 provide horizontal stability in a direction perpendicular to axis 70.

Figure 5:
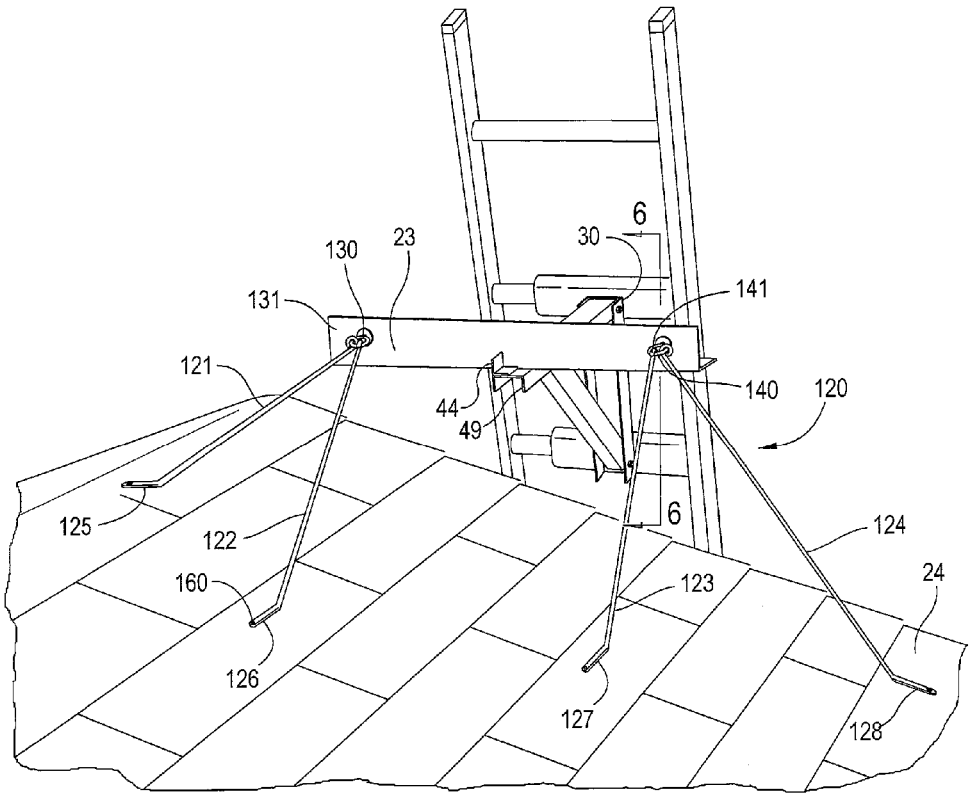
FIG. 5 is a perspective view of the preferred embodiment of a standoff support positioned atop a roof and attached to the ladder jack of FIG. 2.
Figure 6:
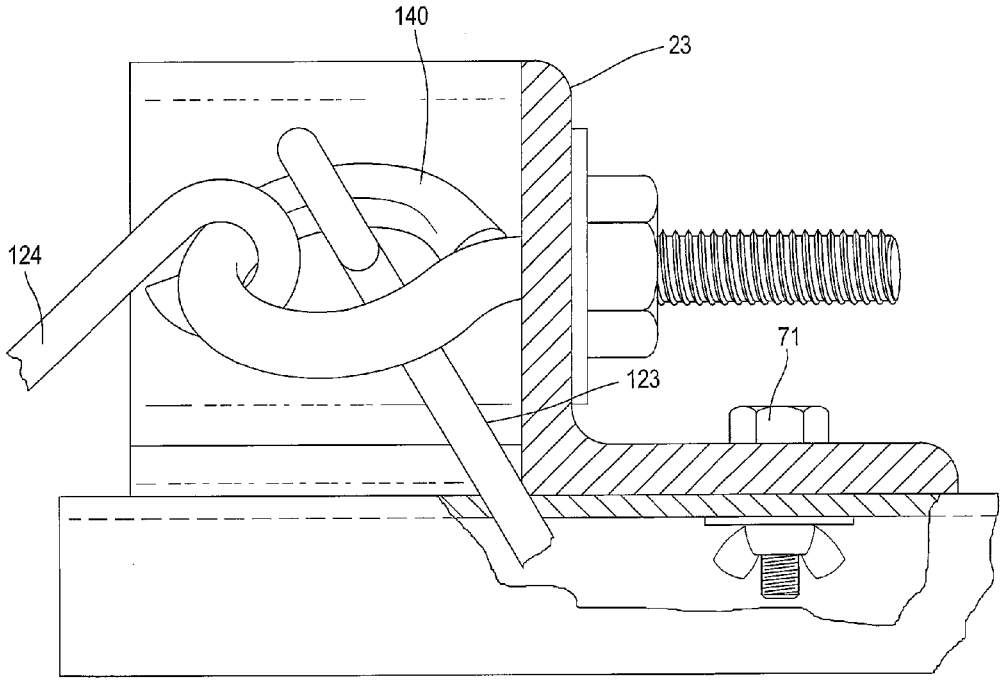
FIG. 6 is an enlarged fragmentary cross-sectional view of eye bolt 140 taken along line 6-6 of FIG. 5.

The preferred embodiment of the Ladder Standoff Support is shown in FIGS. 5 and 6. The preferred embodiment is identical to the alternative embodiment except that the two posts 21 and 22 (FIG. 3) and stabilizing rods 61 and 62 have been deleted and replaced by a first pair of stabilizing rods 121 and 122 (FIG. 5) and a second pair of stabilizing rods 123 and 124 which are mounted to the opposite ends of member 23 instead of the center of member 23. The same ladder jack 30 is utilized with both embodiments.

Member 23 (FIG. 5) of ladder jack 30 is has a right angle configuration and is fixedly mounted to member 31 by fastener 71 extending through the horizontal leg of member 23. The vertically extending wall 150 of member 23 has a pair of eye bolts 130 and 140 (FIG. 5) which are fixedly mounted thereto instead of the single eye bolt 63 (FIG. 4) of the alternative embodiment. Eye bolt 130 is mounted to the end portion 131 of member 23 whereas eye bolt 140 is mounted to the opposite end portion 141 of member 23. Fastener 71 extends through slot 45 (FIG. 6) The first pair of stabilizing rods 121 and 122 have proximal ends movably and pivotably mounted to the ring shaped end of eye bolt 130 in a manner identical to the mounting arrangement for the mounting of stabilizing rods 61 and 62 to eye bolt 60. Likewise, rods 123 and 124 are movably and pivotably mounted to the ring shaped end of eye bolt 140 in the identical manner. Eye bolts 130 and 140 are identical to eye bolt 60.

Supporting rods 121 and 122 have respectively bent distal ends 125 and 126 (FIG. 5) whereas supporting rods 123 and 124 have respectively bent distal ends 127 and 128. The distal ends 125 through 128 are arranged to be parallel to the slanted roof thereby providing stabilization of the ladder support 120. Typically, rods 121 and 124 will extend further out than the horizontal width of member 23 whereas rods 122 and 123 will extend generally within the horizontal width of member 23. Each distal end 125-128 have holes 160 extending therethrough in order to receive nails or screws to extend through the distal ends and into the roof thereby providing further support.

The ladder standoff support allows the ladder, ladder jack and platform atop the ladder jack to be spaced apart from the roof by positioning the stabilizing rods atop the roof in a position so that the mounting member 23 is located adjacent the edge of the roof thereby positioning the ladder, ladder jack and platform to the side of the roof. The invention disclosed herein is particularly useful in spacing a platform upon which the work stands apart from the roof. In such a case, two ladders each with a separate ladder jack mounted thereto are position to the side of the roof with the opposite ends of the platform resting atop and being supported by the two ladder jacks. Each ladder jack is provided with a ladder standoff support thereby maintaining the two ladders with ladder jacks and platform apart from and to the side of the roof.

Many variations in the present invention are contemplated and included. For example, the distal ends of the stabilizing rods are arranged at an obtuse angle with respect to the straight main bodies of the rods although angles other than obtuse are included. Typically the outer rods 121 and 124 (FIG. 5) are extended to a position outwardly of the opposite end portions 131 and 141 limiting movement of the ladder and ladder jack along an axis extending between the opposite end portions 131 and 141 of the mounting member 23 while the inner rods 122 and 123 are extended to a position between the end portions 131 and 141 in order to increase the stability of the combination. Rods 122 and 123 extend in a direction different from said rods 121 and 124 further increasing the stability.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. The combination:

a ladder jack for mounting a ladder for holding a platform near a roof; and, a ladder standoff support mountable to said ladder jack for spacing a platform and ladder jack from a roof, said ladder jack having a mounting member positionable near said roof, said support having a first pair of stabilizing rods extendible away from said ladder jack and having proximal ends pivotably mounted to said mounting member and distal ends positionable atop a roof and a second pair of stabilizing rods extendible away from said ladder jack and having proximal ends pivotably mounted to said mounting member and distal ends positionable atop the roof and spacing said ladder jack apart from the roof while limiting movement thereof.

2. The combination of claim 1 wherein:

said mounting member has a first end portion and a second end portion opposite to said first end portion, said first pair of stabilizing rods are mounted to one end portion and said second pair of stabilizing rods are mounted to said second end portion.

3. The combination of claim 2 wherein:

each rod has a main body which is straight except for the distal end which is arranged at an obtuse angle relative to said main body.

4. The combination of claim 3 wherein:

said first pair and said second pair of stabilizing rods have outer stabilizing rods and inner stabilizing rods with said outer stabilizing rods extendible outwardly of the first end portion and second end portion of said mounting member whereas said inner stabilizing rods are extendible to a position between said first end portion and said second end portion of said mounting member.

5. The combination of claim 4 wherein:

said ladder jack has a top member upon to support a platform, said ladder jack further having a downwardly extending bracket with a top end pivotally mounted to said top member with said downwardly extending bracket including a pair of ladder rung engaging brackets, said ladder jack further having an angle bracket with a top end slideably mounted to said top member and a bottom end pivotally mounted to said downwardly extending member allowing said top member to be adjusted to extend horizontally to restingly support the platform in a horizontal position.

* * * * *